United States Patent [19]

Leighton et al.

[11] Patent Number: 4,484,360

[45] Date of Patent: Nov. 27, 1984

[54] SHIN GUARD AND METHOD OF MAKING

[75] Inventors: Kenneth B. Leighton, Solon; Michael J. Silvestro, Stow, both of Ohio

[73] Assignee: Spectrum Sports, Inc., Twinsburg, Ohio

[21] Appl. No.: 541,430

[22] Filed: Oct. 13, 1983

[51] Int. Cl.[3] ..... A41D 13/00; A41D 13/06

[52] U.S. Cl. ..... 2/22; 2/23; 2/24; 2/59; 2/61; 2/62; 2/425

[58] Field of Search ..... 2/22, 23, 24, 425, 59, 2/61, 62

[56] References Cited

U.S. PATENT DOCUMENTS

| | | | |
|---|---|---|---|
| 2,553,612 | 5/1951 | Taylor | 2/22 |
| 2,785,407 | 2/1954 | Reeder | 2/22 |
| 3,044,075 | 3/1960 | Rawlings | 2/22 |
| 3,322,118 | 7/1964 | Sotherlin | 2/24 |
| 3,322,873 | 5/1967 | Hitchcock | 2/24 |
| 3,465,364 | 5/1967 | Edelson | 2/22 |
| 3,588,914 | 11/1969 | Ihnat | 2/425 |
| 3,735,419 | 5/1973 | Byrd | 2/22 |
| 4,292,263 | 9/1981 | Hanrahan et al. | 2/23 |
| 4,346,205 | 8/1982 | Hiles | 528/53 |
| 4,354,280 | 10/1982 | Hayes | 2/24 |

FOREIGN PATENT DOCUMENTS

| | | | |
|---|---|---|---|
| 2362044 | 12/1923 | Fed. Rep. of Germany | 2/22 |
| 2506132 | 11/1982 | France | 2/24 |
| 1572159 | 7/1950 | United Kingdom | 2/22 |
| 1567191 | 3/1980 | United Kingdom | 2/22 |
| 2073009 | 10/1981 | United Kingdom | 2/22 |

*Primary Examiner*—Werner H. Schroeder
*Assistant Examiner*—Mary A. Ellis
*Attorney, Agent, or Firm*—Maky, Renner, Otto & Boisselle

[57] ABSTRACT

A shin guard and a method of making it are disclosed. The shin guard has a rigid outer shell of polyurethane and a polyurethane foam backing. A recess is formed in the foam backing by pressing in a hot die having the profile of the recess to be made. The recess is oblong and centered over the shin bone or tibia. A dense, modified polyurethane is then cast in the recess. The combination of polyurethane foam and dense, modified polyurethane provides excellent shock absorption in a light weight shin guard.

8 Claims, 3 Drawing Figures

SHIN GUARD AND METHOD OF MAKING

BACKGROUND OF THE INVENTION

The present invention relates to athletic shin guards.

For many years players of certain sports such as soccer, hockey, field hockey, and others, have found it advantageous to protect their shins with shin guards. The shin guards used have generally included a protective barrier shaped generally to fit the forward facing portion of the shin. These shin guards have been worn either inside the players' socks or have been attached by means of straps which extend around the leg.

Some prior art shin guards have been constructed with a rigid outer shell backed by a softer foam rubber. However, such shin guards have not provided the maximum possible protection. In U.S. Pat. No. 4,346,205 there is described and claimed a modified, dense polyurethane of essentially linear structure containing unsatisfied hydroxyl groups, having a compression set of less than 15% and preferably less than 5%, an elongation break of at least 500%, and a recovery which is delayed after compression by at least 0.7 seconds. Further, the polyurethane disclosed in said patent has a hardness on the Shore 00 scale not exceeding 50 and preferably in the range of 0 to 10. Said patent declares that its modified dense polyurethanes may find application in sportswear such as shin pads.

SUMMARY OF THE INVENTION

The present invention provides a new and improved shin guard which includes an outer shell made of rigid polyurethane having a contour generally conforming to the shape of the shin. A composite polyurethane backing is attached to the rigid outer shell. The backing comprises a polyurethane foam with an outer contour essentially the same as that of the rigid shell. A vertically extending and centrally located oblong recess in the foam backing is filled with a modified dense polyurethane similar to that disclosed in U.S. Pat. No. 4,346,205.

The invention, then, comprises the features hereinafter fully described and particularly pointed out in the claims, the following description and annexed drawing setting forth in detail an illustrative embodiment of the invention, this being indicative, however, of but one of the various ways in which the principles of the present invention may be carried out.

DESCRIPTION OF THE PREFERRED EMBODIMENT

Figure 1:
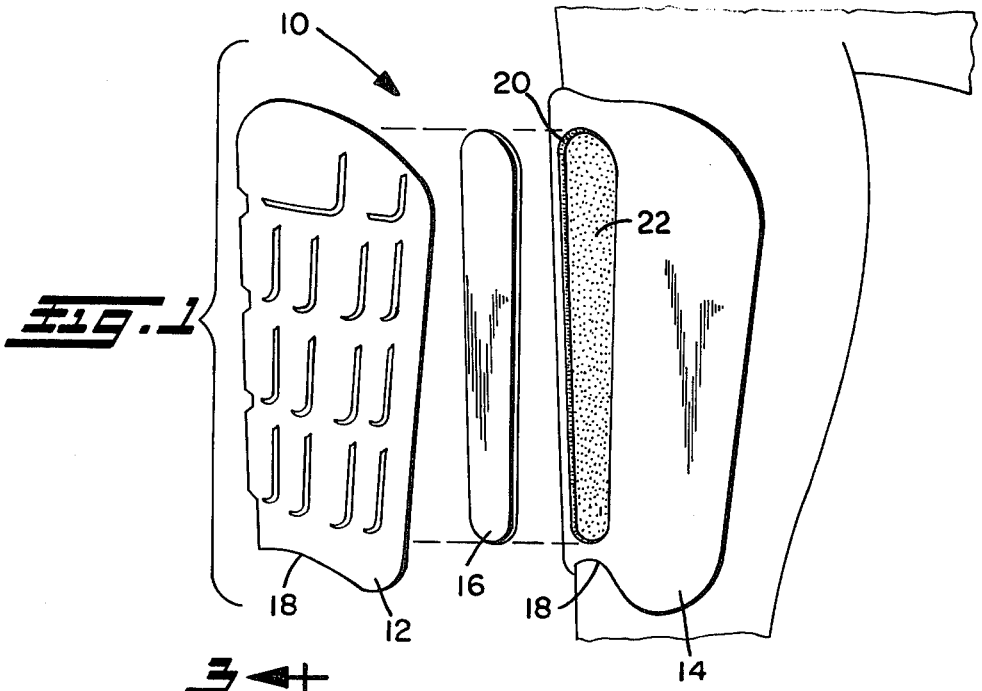
FIG. 1 illustrates an exploded view of a shin guard constructed in accordance with the present invention.
Figure 2:
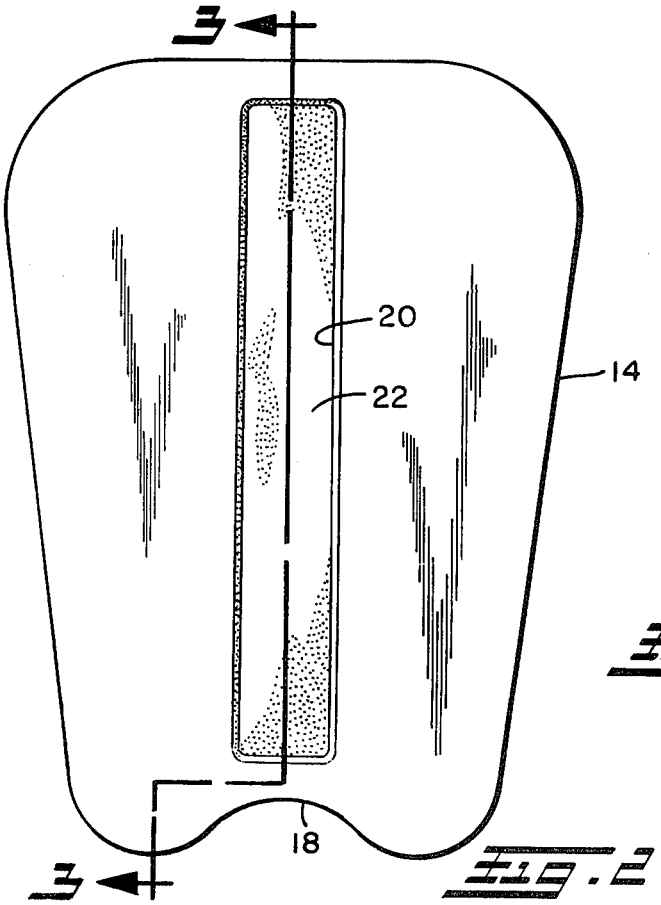
FIG. 2 shows a plan view of one component of the shin guard of FIG. 1.

The shin guard 10 (FIG. 1) includes a rigid outer shell 12, a polyurethane foam backing 14, and a dense, modified polyurethane insert 16. The shin guard 10 is intended to be worn on the shin of an athlete as illustrated in FIG. 1. To this end the shin guard 10 is about 8 inches tall and 5½ to 6 inches wide. Shin guard 10 is curved around a vertical axis to partially surround a shin and has an arcuate cut-out 18 to accommodate ankle movement. The shin guard 10 may be worn inside the socks of the athlete, or it could also be provided with straps or elastic to secure it in place.

The rigid outer shell 12 is formed of a rigid polyurethane material and protects the foam backing 14 and the modified, dense polyurethane insert 16 from abrasion while at the same time distributing applied forces over a wide area. The polyurethane foam backing 14 has an outer perimeter essentially the same as that of the rigid outer shell 12 and is about one eighth of an inch thick. The polyurethane foam backing 14 is glued to the shell after the insert 16 is in place. The foam backing 14 serves as a lightweight carrier for the modified, dense polyurethane insert 16, but itself provides only minor protection from impact. Preferably the foam backing 14 has a hardness on the Shore 00 scale of between 30 and 60, and preferably between 40 and 50.

Figure 3:
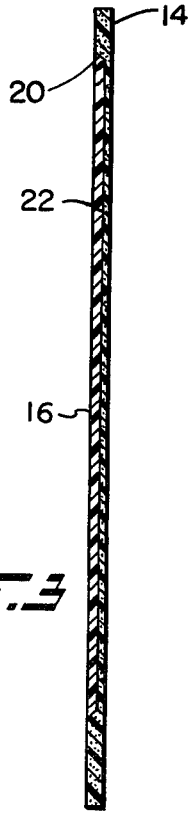
FIG. 3 is a sectional view taken along line 3—3 of FIG. 2 with the insert included.

The backing 14 is provided with an oblong recess 20 which may be approximately 6½ inches long and one inch wide. The recess 20 extends vertically and overlays the shin bone or tibia of the shin guard user. The recess 20 extends into the foam backing approximately 0.090 inches. Thus there is a relatively thin bottom 22 (FIG. 3) to the recess 20.

The recess 20 may be formed by stamping or pressing the foam backing 14 with a hot die conforming to the desired shape of the recess 20. This process melts the polyurethane in the area where the recess 20 is to be formed and creates a skin over the entire interior surface of the recess 20.

The insert 16 is formed of a modified, dense polyurethane and is cast in place in the recess 20. In this way, the polyurethane of the insert 16 is intimately bonded with the polyurethane foam of the backing 14.

The insert 16 is formed of a material similar to that disclosed in U.S. Pat. No. 4,346,205, the disclosure of which is incorporated herein by reference. However, it is preferred in carrying out the present invention that the modified, dense polyurethane used to make the insert 16 have a Shore hardness of between 20 and 70 on the 00 scale. Said U.S. Patent discloses a modified, dense non-cellular polyurethane having a hardness not exceeding 50 and preferably not exceeding 20 and most preferably in the range of 0 to 10. In order to form the polyurethane of the present invention, it is necessary to decrease the percentage of unsatisfied hydroxyl groups from about 1 in 5 in the aforementioned U.S. Patent to approximately 1 in 4.

The resulting modified, dense non-cellular polyurethane absorbs impact approximately with the same efficiency that human tissue does. Upon impact, the modified dense polyurethane distorts laterally and does not return to its initial configuration until after a delay of at least 7/10 of a second. By this time, the impact (usually caused by another player's foot or a game ball) has terminated. Therefore, there is little energy returned to the player's shin in the form of rebound.

The shin guard 10 of the present invention, because of its unique three-component construction, provides an extremely lightweight and very effective shin guard. The shin guard 10 provides excellent energy dissipation immediately in front of the shin bone or tibia where it is most required. In areas where the extra protection is not required, the conventional polyurethane foam backing 14 is utilized. The rigid outer shell 12 spreads the applied impact forces widely.

The following is claimed:

1. A shin guard comprising a rigid outer shell, a foam backing bonded to said shell, and a dense, modified polyurethane insert bonded to said backing, said insert being disposed between said backing and said rigid shell.

2. A shin guard comprising a rigid outer shell, a foam backing bonded to said shell, and a dense modified polyurethane insert bonded to said backing, said insert being received in a recess formed in said backing, said insert also being disposed between said backing and said outer shell.

3. The shin guard of claim 2 wherein said insert includes a non-cellular polyurethane of essentially linear structure containing unsatisfied hydroxyl groups, having a compression set less than 15%, an elongation break of at least 500%, a recovery after compression delayed by at least 7/10 of a second, and a hardness on the Shore scale not exceeding 70.

4. The shin guard of claim 3 wherein said compression set is less than 5%.

5. The shin guard of claim 3 having a hardness on the Shore 00 scale of between 20 and 70.

6. A method of making a shin guard comprising the steps of forming a recess in a polyurethane foam backing, casting a dense, modified polyurethane foam in said recess, and adhering the resultant structure to a rigid outer shell.

7. The method of claim 6 in which said step of forming a reeess includes the step of pressing a hot die into the polyurethane foam backing, the hot die having the contour of the recess to be formed.

8. The method of claim 9 wherein said step of casting a dense, modified polyurethane includes the step of casting a flexible, non-cellular polyurethane of essentially linear structure containing unsatisfied hydroxyl groups, having a compression set less than 15%, an elongation at break of at least 500%, a recovery after compression delayed by at least 7/10 of a second, and a hardness on the Shore 00 scale not exceeding 70.

* * * * *